US010661193B2

(12) United States Patent
Chiang

(10) Patent No.: US 10,661,193 B2
(45) Date of Patent: May 26, 2020

(54) CHAIN-SHAPED SPLICING TOY

(71) Applicant: LI HSEN PLASTICS CO., LTD., New Taipei (TW)

(72) Inventor: San-Lang Chiang, New Taipei (TW)

(73) Assignee: LI HSEN PLASTICS CO., LTD., New Taipei (TW)

( * ) Notice: Subject to any disclaimer, the term of this patent is extended or adjusted under 35 U.S.C. 154(b) by 31 days.

(21) Appl. No.: 16/026,063

(22) Filed: Jul. 3, 2018

(65) Prior Publication Data

US 2020/0009470 A1 Jan. 9, 2020

(51) Int. Cl.
*A63H 33/10* (2006.01)

(52) U.S. Cl.
CPC ..... *A63H 33/10* (2013.01)

(58) Field of Classification Search
CPC ..... A63H 33/10; A63H 33/06; A63H 33/062; A63H 33/065; A63H 33/067; A63H 33/08; A63H 33/101; A63H 33/102; A63H 33/108; A63H 33/112; A63H 33/12
USPC ..... 446/124, 125, 119
See application file for complete search history.

(56) References Cited

U.S. PATENT DOCUMENTS 3,604,145 A * 9/1971 Zimmerman ..... A63H 33/065 446/108
6,672,931 B1 * 1/2004 Bagley ..... A63H 33/08 446/106
6,948,998 B2 * 9/2005 Bagley ..... A63H 33/062 446/104

* cited by examiner

*Primary Examiner* — John E Simms, Jr.
*Assistant Examiner* — Rayshun K Peng
(74) *Attorney, Agent, or Firm* — Fei-Hung Yang

(57) ABSTRACT

A chain-shaped splicing toy is attached to a ball so that a plurality of balls can be spliced with each other. The chain-shaped splicing toy includes a first chain assembly. The first chain assembly has two first coupling portions, a first ring, two first buckling portions, and a plurality of first chain connecting portions. Wherein, when the first chain assembly is attached to the ball, the first coupling portion at one end is coupled to the first ring at the other end. The first buckling portions are buckled to the first coupling portion that is not located at one end of another first chain assembly attached to the other ball so that the balls can be spliced with each other in different shapes and models.

9 Claims, 4 Drawing Sheets

CHAIN-SHAPED SPLICING TOY

FIELD OF THE INVENTION

The present invention relates to a chain-shaped splicing toy, and more particularly to a chain-shaped splicing toy that can be attached to a ball so that young children can splice balls with each other to form a desired shape when playing in a ball pool.

BACKGROUND OF THE INVENTION

Nowadays, in order to cultivate young children's creative thinking, imagination and creativity, parents often purchase toys that can be freely assembled or combined for children to play. The most common toys are jigsaw puzzles and building blocks.

However, when young children play in a game space with a ball pool, they do not bring the above-mentioned toys together. If young children play in the ball pool for a long time, they may feel slightly boring and less interesting. Creativity and imagination are also less likely to increase. Therefore, in addition to the fun, the problem how to enhance the creative thinking, imagination and creativity when young children play in a ball pool needs to be solved.

Accordingly, the inventor of the present invention has devoted himself based on his many years of practical experiences to solve these problems.

SUMMARY OF THE INVENTION

The primary object of the present invention is to provide a chain-shaped splicing toy. When young children play in a ball pool, the balls can be spliced together, thereby enhancing the creative thinking, imagination and creativity of young children and having the fun of play.

In order to achieve the aforesaid object, the chain-shaped splicing toy of the present invention is attached to and surrounds a ball so that a plurality of balls can be spliced with each other. The chain-shaped splicing toy comprises a first chain assembly. The first chain assembly has two first coupling portions, a first ring, two first buckling portions, and a plurality of first chain connecting portions. The first coupling portions, the first ring and the first buckling portions are linked with each other through the first chain connecting portions, respectively. Two ends of the first chain assembly are one of the first coupling portions and the first ring, respectively. The first coupling portion located at one end of the first chain assembly is linked with one of the first buckling portions and provided with a first outer annular portion close to a periphery thereof. The other first coupling portion except the first coupling portion located at one end of the first chain assembly is linked between the first buckling portions. Wherein, when the first chain assembly is attached to and surrounds the ball, the first coupling portion at one end of the first chain assembly is coupled to the first ring at the other end of the first chain assembly through the first outer annular portion. The first buckling portions are buckled to the first coupling portion that is not located at one end of another first chain assembly attached to the other ball so that the balls can be spliced with each other.

Preferably, the first coupling portions, the first ring and the first buckling portions each have a curved surface corresponding to a surface of the ball, so that the first chain assembly can be attached to the ball stably.

Preferably, the first chain assembly is formed with a first curved bent portion at the joint of the first ring and the first chain connecting portion connected with the first ring, so that the first ring at one end can be easily connected and fixed to the first coupling portion at the other end.

In some embodiments, the chain-shaped splicing toy further comprises a second chain assembly. The second chain assembly has two second coupling portions, three second rings, and a plurality of second chain connecting portions. The second coupling portions and the second rings are linked with each other through the second chain connecting portions, respectively. Two ends of the second chain assembly are one of the second coupling portions and one of the second rings, respectively. The second coupling portion located at one end of the second chain assembly is linked with a corresponding one of the second rings and provided with a second outer annular portion close to a periphery thereof. The other second coupling portion except the second coupling portion located at one end of the second chain assembly is linked between the other second rings except the second ring located at the other end of the second chain assembly. When the second chain assembly is attached to and surrounds the ball, the second coupling portion at one end of the second chain assembly is coupled with the second ring at the other end of the second chain assembly through the second outer annular portion. The second chain assembly is attached to and surrounds the ball having the first chain assembly and intersected with the first chain assembly. In addition to being spliced in the same direction, the balls can be spliced in the other direction through the second chain assembly, so that the balls can be spliced together in different shapes.

Preferably, the second coupling portions each have a curved surface corresponding to the surface of the ball, so that the second chain assembly can be attached to the ball stably.

Preferably, the second chain assembly is formed with a second curved bent portion at the joint of the second ring at the other end of the second chain assembly and the second chain connecting portion connected with the second ring at the other end of the second chain assembly, so that the second ring at one end can be easily connected and fixed to the second coupling portion at the other end.

Preferably, the first buckling portions and the second buckling portions each have a barbed structure to improve the stability of connection.

Preferably, the first chain assembly and the second chain assembly are made of a soft plastic material, improving the safety of play.

Thereby, the first chain assembly and the second chain assembly of the present invention are attached to the balls, so that the balls can be spliced with each other. Through the chain-shaped assembly, the balls in the ball pool can be combined with each other. When young children play in the ball pool, the balls can be spliced in different shapes or models, thereby increasing imagination and creativity in addition to more fun.

DETAILED DESCRIPTION OF THE PREFERRED EMBODIMENTS

Embodiments of the present invention will now be described, by way of example only, with reference to the accompanying drawings.

Figure 1:
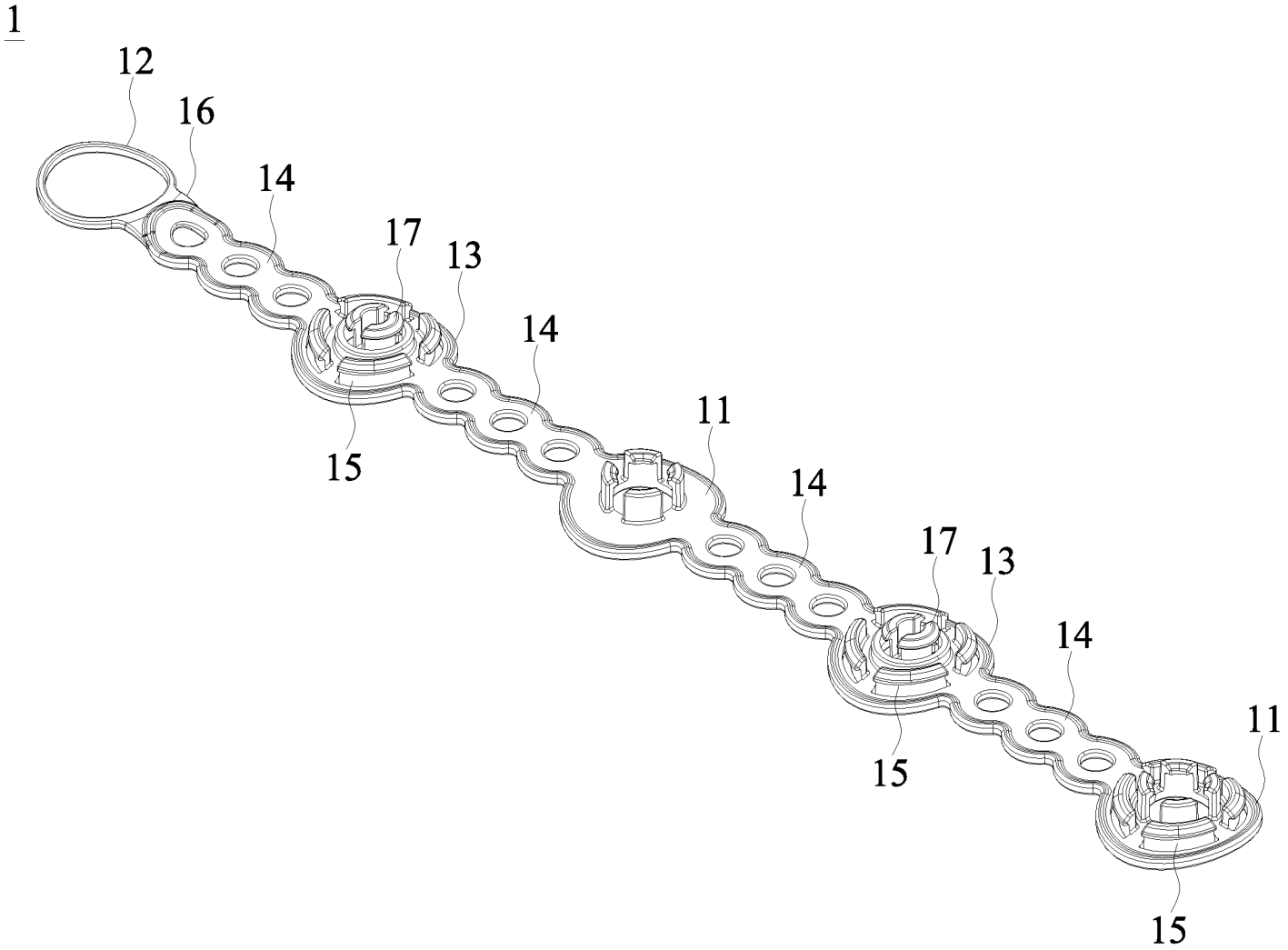
FIG. 1 is a schematic view of a first chain assembly in accordance with a first embodiment of the present invention.
Figure 2:
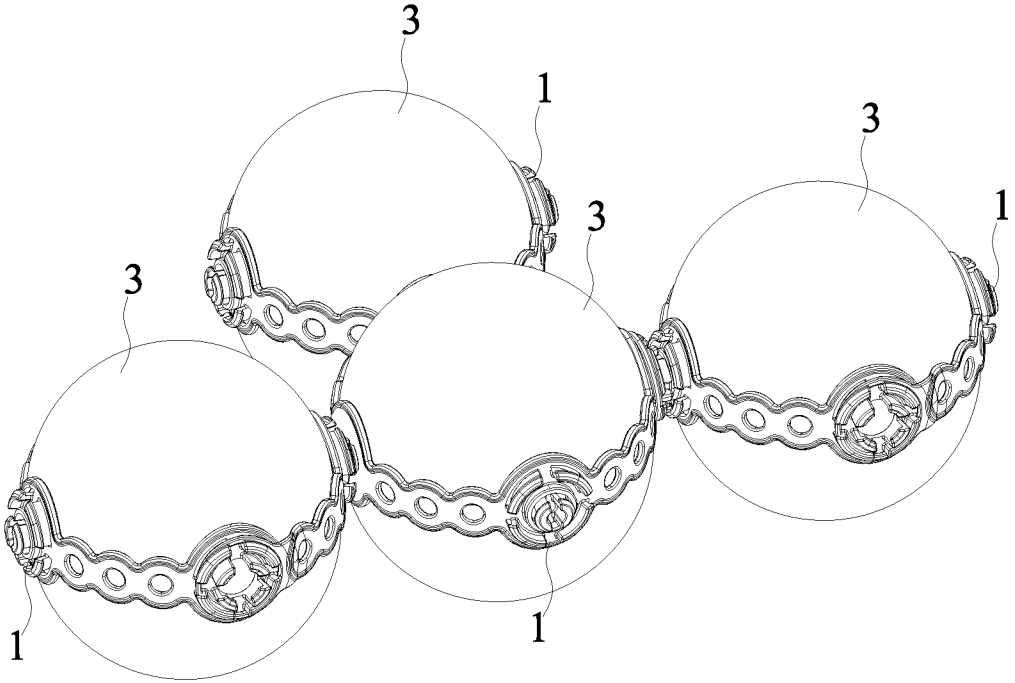
FIG. 2 is a schematic view in accordance with the first embodiment of the present invention when in use.

FIG. 1 is a schematic view of a first chain assembly in accordance with a first embodiment of the present invention. FIG. 2 is a schematic view in accordance with the first embodiment of the present invention when in use. As shown in FIG. 1 and FIG. 2, the present invention discloses a chain-shaped splicing toy that can be attached to a ball 3 for a plurality of balls 3 to be spliced with each other. Wherein, the chain-shaped splicing toy has a first chain assembly 1. The first chain assembly 1 has two first coupling portions 11, a first ring 12, two first buckling portions 13, and a plurality of first chain connecting portions 14. The first coupling portions 11, the first ring 12 and the first buckling portions 13 are linked with each other through the first chain connecting portions 14, respectively. Two ends of the first chain assembly 1 are one of the first coupling portions 11 and the first ring 12, respectively. The first coupling portion 11 located at one end of the first chain assembly 1 is linked with one of the first buckling portions 13 and is provided with a first outer annular portion 15 close to the periphery thereof. The other first coupling portion 11 that is not the first coupling portion 11 located at one end of the first chain assembly 1 is linked between the first buckling portions 13.

When in use, the first chain assembly 1 is placed on the surface of one ball 3, and then the first outer annular portion 15 of the first coupling portion 11 at one end of the first chain assembly 1 is coupled with the first ring 12 at the other end of the first chain assembly 1, so that the first chain assembly 1 is attached to the ball 3. In the same way, each of the other balls is surrounded by the first chain assembly 1. The first buckling portions 13 of any one first chain assembly 1 is buckled to the first coupling portion 11 that is not located at one end of another first chain assembly 1 on the other ball 3, so that the balls 3 can be spliced with each other and arranged in a desired shape.

In addition, in this embodiment, the first coupling portions 11, the first ring 12 and the first buckling portions 13 each have a curved surface corresponding to the surface of the ball 3. Thereby, when the first chain assembly 1 is attached to the ball 3, it can be more stable and cannot be easily moved by an external force. Besides, the first chain assembly 1 is formed with a first curved bent portion 16 at the joint of the first ring 12 and the first chain connecting portion 14 connected with the first ring 12. Therefore, the first ring 12 at one end can be easily connected and fixed to the first coupling portion 11 at the other end, so that the circumferential fixation can be more stable. Furthermore, when the first chain assembly 1 of the present invention is attached to the ball 3, it substantially matches with the circumference of the ball 3 about 5-8 cm in diameter, so that the first chain assembly 1 can be perfectly circumferentially attached to the ball 3.

Figure 3:
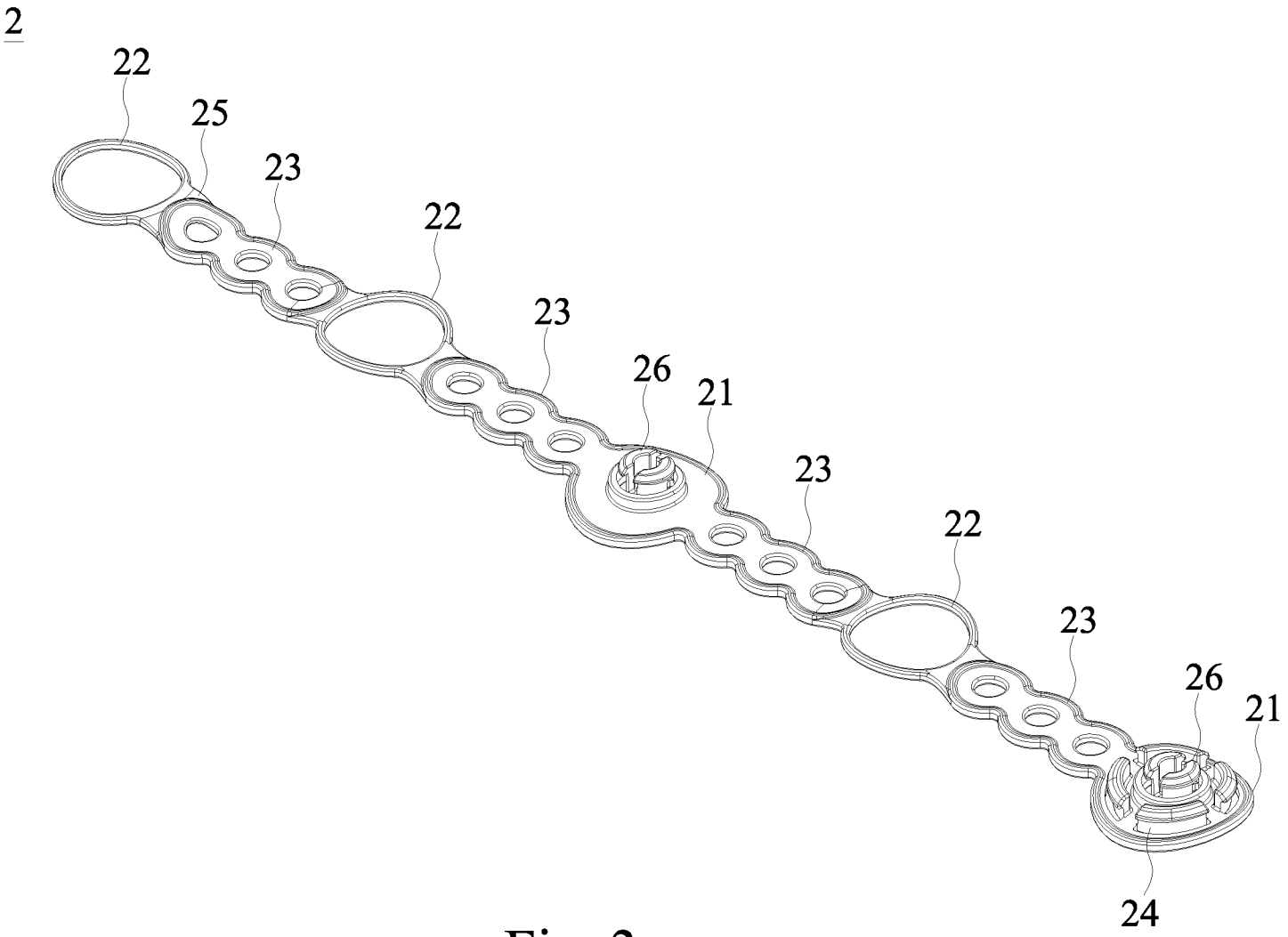
FIG. 3 is a schematic view of a second chain assembly in accordance with a second embodiment of the present invention.
Figure 4:
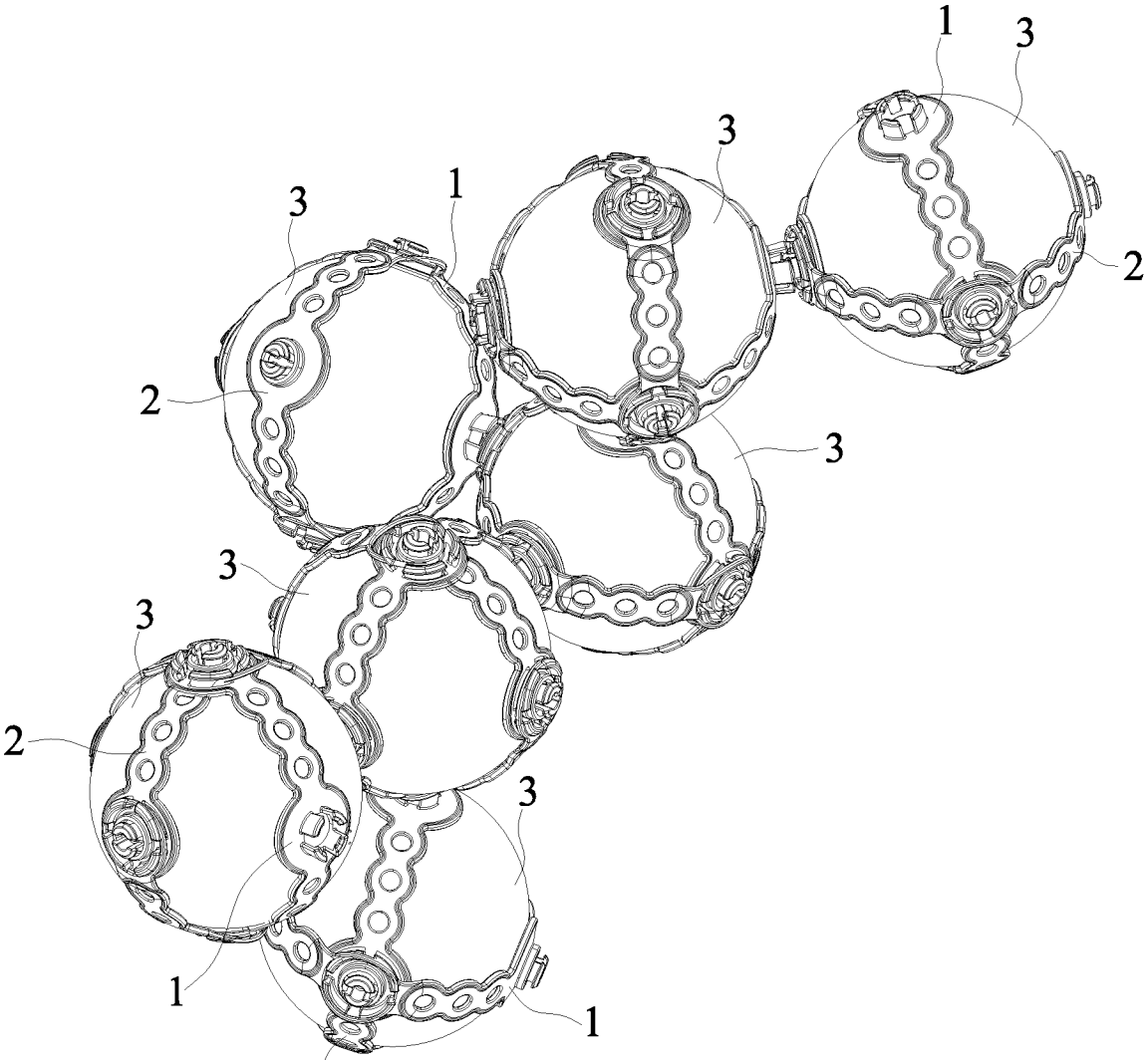
FIG. 4 is a schematic view in accordance with the second embodiment of the present invention when in use.

FIG. 3 is a schematic view of a second chain assembly in accordance with a second embodiment of the present invention. FIG. 4 is a schematic view in accordance with the second embodiment of the present invention when in use. As shown in FIG. 3 and FIG. 4, compared with the first embodiment, in the second embodiment, the present invention further comprises a second chain assembly 2. The second chain assembly 2 has two second coupling portions 21, three second rings 22, and a plurality of second chain connecting portions 23. The second coupling portions 21 and the second rings 22 are linked with each other through the second chain connecting portions 23, respectively. Two ends of the second chain assembly 2 are one of the second coupling portions 21 and one of the second rings 22, respectively. The second coupling portion 21 located at one end of the second chain assembly 2 is linked with a corresponding one of the second rings 22 and provided with a second outer annular portion 24 close to the periphery thereof. The other second coupling portion 21 except the second coupling portion 21 located at one end of the second chain assembly 2 is linked between the other second rings 22 except the second ring 22 located at the other end of the second chain assembly 2.

When in use, after the first chain assembly 1 is mounted on the ball 3, the second chain assembly 2 is attached to and surrounds the ball 3 having the first chain assembly 1. The second outer annular portion 24 of the second coupling portion 21 at one end of the second chain assembly 2 is coupled with the second ring 22 at the other end of the second chain assembly 2. The first buckle portions 13 of the first chain assembly 1 are also provided with the first outer annular portions 15 close to their respective peripheries, such that the other second rings 22 of the second chain assembly 2 are buckled to the first outer annular portions 15 of the first buckling portions 13, respectively. The second chain assembly 2 and the first chain assembly 1 are attached to the ball 3 and intersected with each other, as shown in FIG. 4. Such an intersecting arrangement makes the assembly of the balls 3 have more selections in different directions. That is, in the first embodiment, the balls can only be spliced and arranged in a planar manner. In the second embodiment, the balls can be spliced and arranged in a three-dimensional manner to increase the fun of the present invention and enable young children to fully use their imagination and creativity to splice balls.

In addition, in this embodiment, the second coupling portions 21 each have a curved surface corresponding to the surface of the ball 3. Thereby, when the second chain assembly 2 is attached to the ball 3, it can be more stable and cannot be easily moved by an external force. Besides, the second chain assembly 2 is formed with a second curved bent portion 26 at the joint of the second ring 22 at the other end of the second chain assembly 2 and the second chain connecting portion 23 connected with the second ring 22 at the other end of the second chain assembly 2. Therefore, the second ring 22 at one end can be easily connected and fixed to the second coupling portion 21 at the other end, so that the circumferential fixation can be more stable. Furthermore, when the second chain assembly 2 of the present invention is attached to the ball 3, it substantially matches with the circumference of the ball 3 about 5-8 cm in diameter, so that the second chain assembly 2 can be perfectly circumferentially attached to the ball 3.

In the above two embodiments, the first buckling portions 13 and the second buckling portions 21 each may have a barbed structure (17, 26), which make the connection more stable and tight. The barbed structure (17, 26) has a curved edge for the convenience of disengagement after applying a certain force. In this way, the buckling portions still can be separated, and the barbed structure (17, 26) will not be damaged. The convenience of separation is also taken into consideration when the stability of the connection is improved. In addition, the first chain assembly 1 and the second chain assembly 2 may be made of a soft plastic material to prevent young children from being hurt when young children play in the ball pool, thereby increasing the safety of playing.

In summary, through the first chain assembly 1 and/or the second chain assembly 2 provided by the present invention, the balls 3 in the ball pool can be spliced with each other in different shapes or models, having a certain fun, so that young children will not be too boring when playing in the ball pool. Besides, the present invention can enhance the imagination, creativity and creative thinking of young children. Moreover, because the chain-shaped splicing toy of the present invention is made of a soft material, it takes into consideration the safety of playing, thereby protecting the safety of young children when playing.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A chain-shaped splicing toy, attached to a ball for splicing a plurality of balls with each other, characterized by:

the chain-shaped splicing toy comprising a first chain assembly, the first chain assembly having two first coupling portions, a first ring, two first buckling portions and a plurality of first chain connecting portions, the first coupling portions, the first ring and the first buckling portions being linked with each other through the first chain connecting portions respectively, two ends of the first chain assembly being one of the first coupling portions and the first ring respectively, the first coupling portion located at one end of the first chain assembly being linked with one of the first buckling portions and provided with a first outer annular portion close to a periphery thereof, the other first coupling portion except the first coupling portion located at one end of the first chain assembly being linked between the first buckling portions;

wherein when the first chain assembly is attached to and surrounds the ball, the first coupling portion at one end of the first chain assembly is coupled to the first ring at an another end of the first chain assembly through the first outer annular portion, the first buckling portions are buckled to the first coupling portion that is not located at one end of the first chain assembly attached to an another ball so that the plurality of balls can be spliced with each other, wherein the chain-shaped splicing toy further comprises a second chain assembly, the second chain assembly has two second coupling portions, three second rings and a plurality of second chain connecting portions, the second coupling portions and the second rings are linked with each other through the second chain connecting portions respectively, two ends of the second chain assembly are one of the second coupling portions and one of the second rings respectively, the second coupling portion located at one end of the second chain assembly is linked with one of the second rings and provided with a second outer annular portion close to a periphery thereof, the second ring that is not located at one end of the second chain assembly is linked with the second coupling portion that is not located at one end of the second chain assembly; wherein when the second chain assembly is attached to and surrounds the ball, the second coupling portion at one end of the second chain assembly is coupled to the second ring at an another end of the second chain assembly through the second outer annular portion, any of the second chain assembly is attached to the ball having any of the first chain assembly, and the second chain assembly intersects with the first chain assembly.

2. The chain-shaped splicing toy as claimed in claim 1, wherein the first coupling portions, the first ring and the first buckling portions each have a curved surface corresponding to a surface of the ball.

3. The chain-shaped splicing toy as claimed in claim 2, wherein the first ring at an end of each of the first chain assembly has a first curved bent portion at a joint between the first ring and the first chain connecting portion.

4. The chain-shaped splicing toy as claimed in claim 1, wherein the second coupling portions each have a curved surface corresponding to the surface of the ball.

5. The chain-shaped splicing toy as claimed in claim 4, wherein the second ring at one end of the second chain assembly has a second curved bent portion at a joint of the second ring and the second chain connecting portion.

6. The chain-shaped splicing toy as claimed in claim 4, wherein the first buckling portions and the second buckling portions have a barbed structure.

7. The chain-shaped splicing toy as claimed in claim 6, wherein the first chain assembly and the second chain assembly are made of a soft plastic material.

8. The chain-shaped splicing toy as claimed in claim 2, further comprising a second chain assembly, the second chain assembly having two second coupling portions, three second rings and a plurality of second chain connecting portions, the second coupling portions and the second rings being linked with each other through the second chain connecting portions respectively, two ends of the second chain assembly being one of the second coupling portions and one of the second rings respectively, the second coupling portion located at one end of the second chain assembly being linked with one of the second rings and provided with a second outer annular portion close to a periphery thereof, the second ring that is not located at one end of the second chain assembly being linked with the second coupling portion that is not located at one end of the second chain assembly; wherein when the second chain assembly is attached to and surrounds the ball, the second coupling portion at one end of the second chain assembly is coupled to the second ring at an another end of the second chain assembly through the second outer annular portion, any of the second chain assembly is attached to the ball having any of the first chain assembly and intersected with the first chain assembly.

9. The chain-shaped splicing toy as claimed in claim 3, further comprising a second chain assembly, the second chain assembly having two second coupling portions, three second rings and a plurality of second chain connecting portions, the second coupling portions and the second rings being linked with each other through the second chain connecting portions respectively, two ends of the second chain assembly being one of the second coupling portions and one of the second rings respectively, the second coupling portion located at one end of the second chain assembly being linked with one of the second rings and provided with a second outer annular portion close to a periphery thereof, the second ring that is not located at one end of the second chain assembly being linked with the second coupling portion that is not located at one end of the second chain assembly; wherein when the second chain assembly is attached to and surrounds the ball, the second coupling portion at one end of the second chain assembly is coupled to the second ring at an another end of the second chain assembly through the second outer annular portion, any of the second chain assembly is attached to the ball having any of the first chain assembly and intersected with the first chain assembly.

* * * * *